US006394631B1

(12) United States Patent
Yuen

(10) Patent No.: US 6,394,631 B1
(45) Date of Patent: May 28, 2002

(54) SWIVEL LANTERN WITH TRIPOD

(75) Inventor: Se Kit Yuen, Kowloon (HK)

(73) Assignee: John Manufacturing Limited, Kowloon (HK)

( * ) Notice: Subject to any disclaimer, the term of this patent is extended or adjusted under 35 U.S.C. 154(b) by 0 days.

(21) Appl. No.: 09/666,500

(22) Filed: Sep. 18, 2000

(30) Foreign Application Priority Data

May 10, 2000 (GB) ..... 0011309

(51) Int. Cl.[7] ..... F21V 21/40
(52) U.S. Cl. ..... 362/399; 362/413; 362/418
(58) Field of Search ..... 362/388, 399, 362/400, 413, 486, 418

(56) References Cited

U.S. PATENT DOCUMENTS

| | | | | | |
|---|---|---|---|---|---|
| 1,481,998 | A | * | 1/1924 | Eldredge | 362/413 |
| 1,543,293 | A | * | 6/1925 | Nelson | 362/388 |
| 2,034,100 | A | * | 3/1936 | Hoefflinger | 362/388 |
| 2,706,610 | A | * | 4/1955 | Roberts | 362/413 |
| 2,778,931 | A | * | 1/1957 | Cruz | 362/388 |
| 5,142,467 | A | * | 8/1992 | Yuen | 362/399 |
| D332,234 | S | | 1/1993 | Yuen | D10/115 |
| D393,088 | S | | 3/1998 | Yuen | D26/48 |
| D430,323 | S | | 8/2000 | Yuen | D26/46 |
| 6,213,626 | B1 | * | 4/2001 | Qian | 362/413 |

FOREIGN PATENT DOCUMENTS

| | | |
|---|---|---|
| GB | 2091911 | 3/2000 |
| GB | 2091912 | 3/2000 |

* cited by examiner

*Primary Examiner*—Alan Cariaso
(74) *Attorney, Agent, or Firm*—Merchant & Gould P.C.

(57) ABSTRACT

An electrically powered lantern is provided with a handle device (26) comprising three handle elements (28, 34, 36) movable relative to one another between a first position in which said elements provide a handle proper for holding by a user of the lantern and a second position in which said elements provide a tripod support by which the lantern may be supported on a surface.

9 Claims, 8 Drawing Sheets

SWIVEL LANTERN WITH TRIPOD

This invention relates to a hand lantern particularly but not exclusively of the type having a light source energisable by either battery or mains electrical power and it is an object of the invention to provide a new and improved construction of such a lantern.

In accordance with the invention there is provided a lantern comprising a body having a light source and a handle device attached to said body characterised in that the handle device comprises a plurality of handle elements moveable relative to one another between a first position in which said elements provide a handle proper for holding by a user of the lantern and a second position in which said elements provide a support by which the lantern may be supported on a surface.

Said handle elements are preferably all pivotal about a common axis between a said first position in which said elements are in side-by-side relationship to provide said handle proper and a said second position in which said elements are separated from one another to provide said support.

Said common axis conveniently comprises the longitudinal axis of a first elongate member itself pivotal relative to said body about an axis normal to said common axis. The other said axis conveniently comprises the longitudinal axis of a second elongate member mounted on said body.

Said handle elements are preferably retainable in position relative to one another by friction means actuable by rotation of a locking member about said common axis. Said first elongate member may also be retainable relative to said body by friction means actuable by rotation of a locking member about said axis of said second elongate member.

Each of said handle elements conveniently has an outer surface all of which are coplanar in both said first and second positions. Conveniently three such handle elements are provided whereby in said second position said elements provide a tripod by which the lantern may be supported on a surface.

Each of said handle elements is conveniently of elongate form having an outer end provided with said outer surface and an inner end comprising a bushing mounted for rotation about said common axis.

Figure 1:
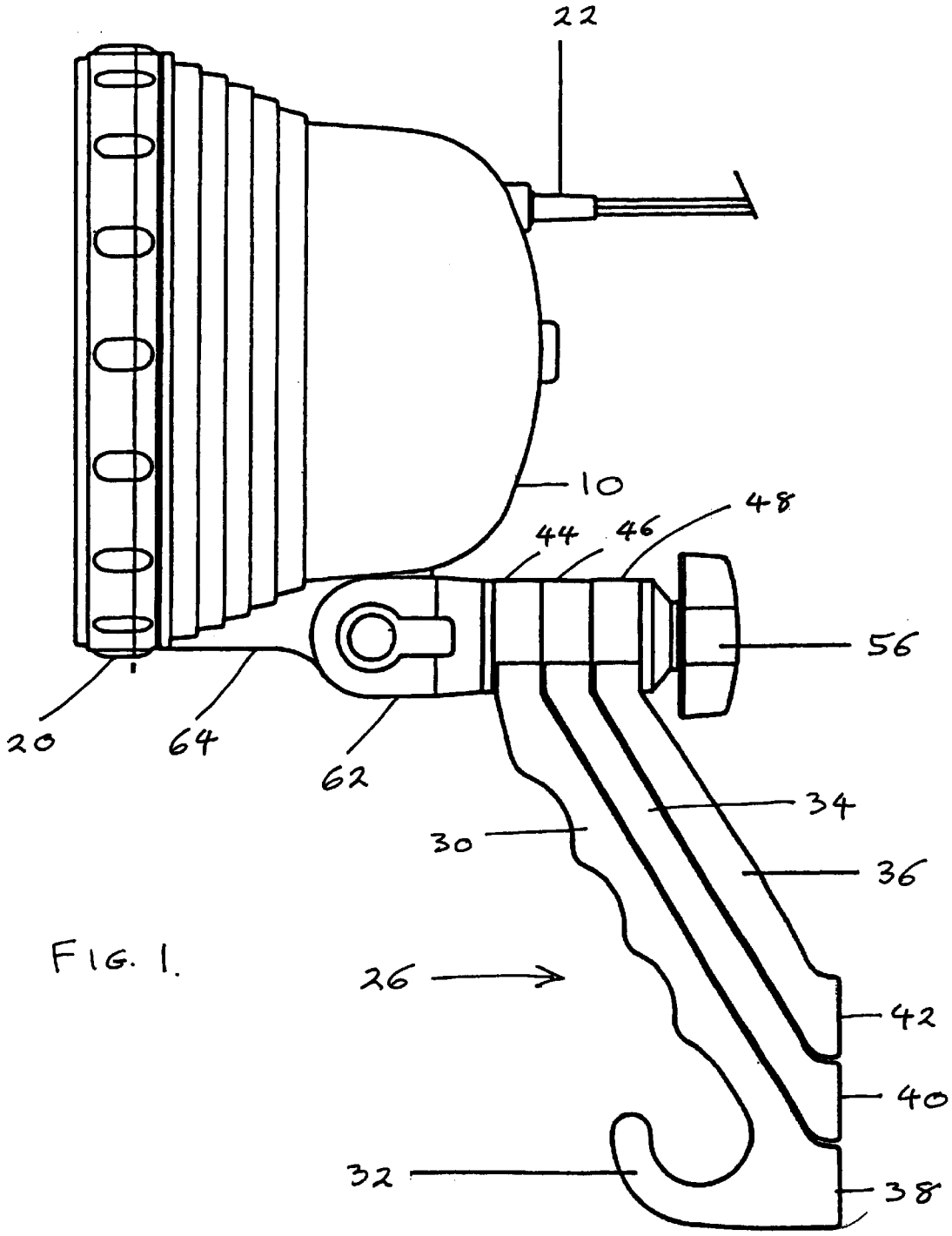
Figure 2:
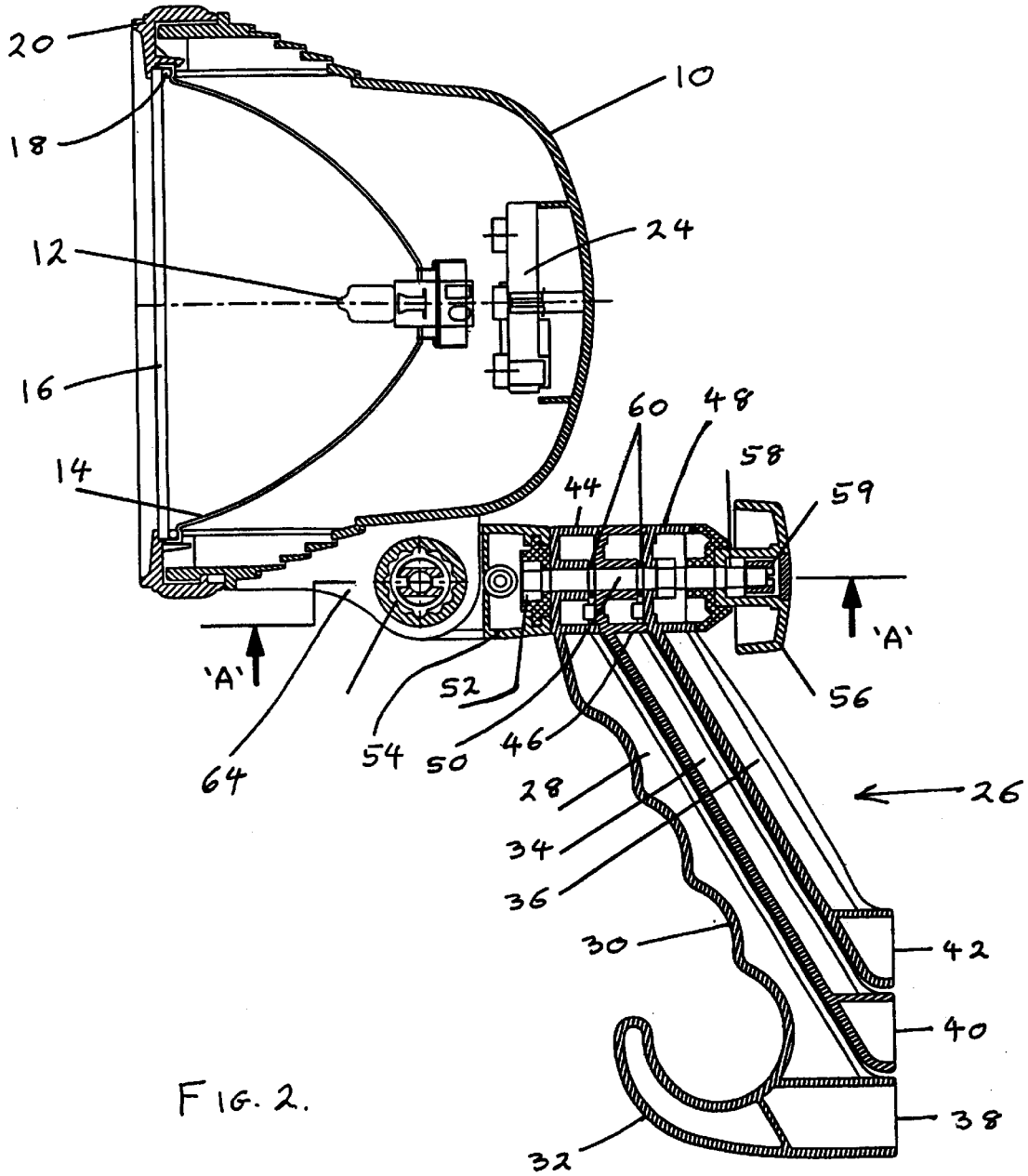
Figure 3:
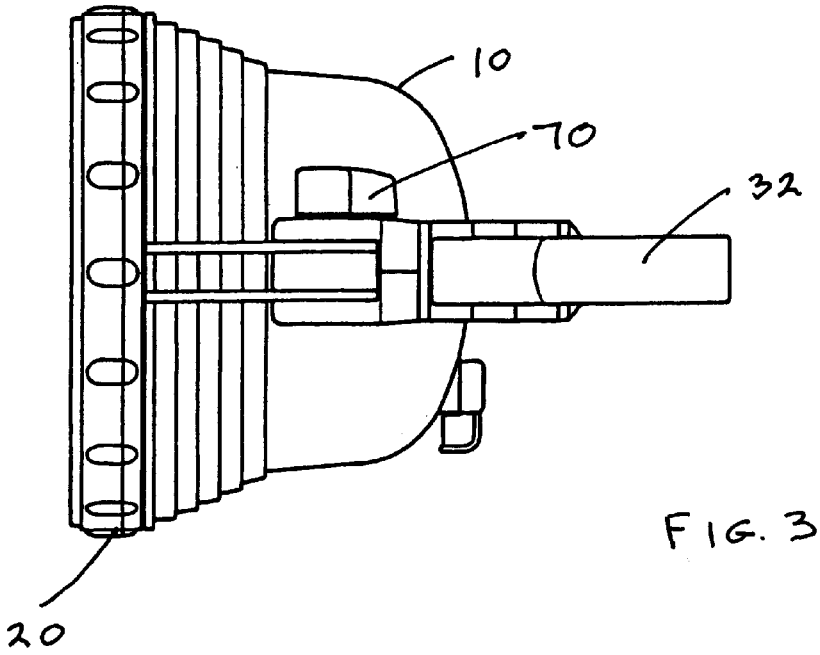
Figure 4:
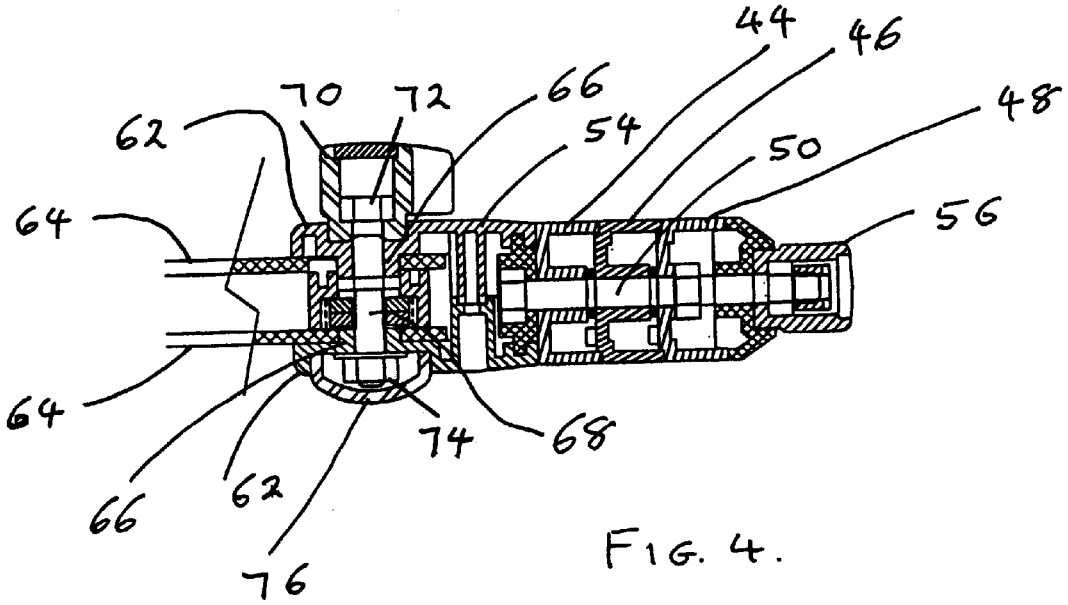
Figure 5:
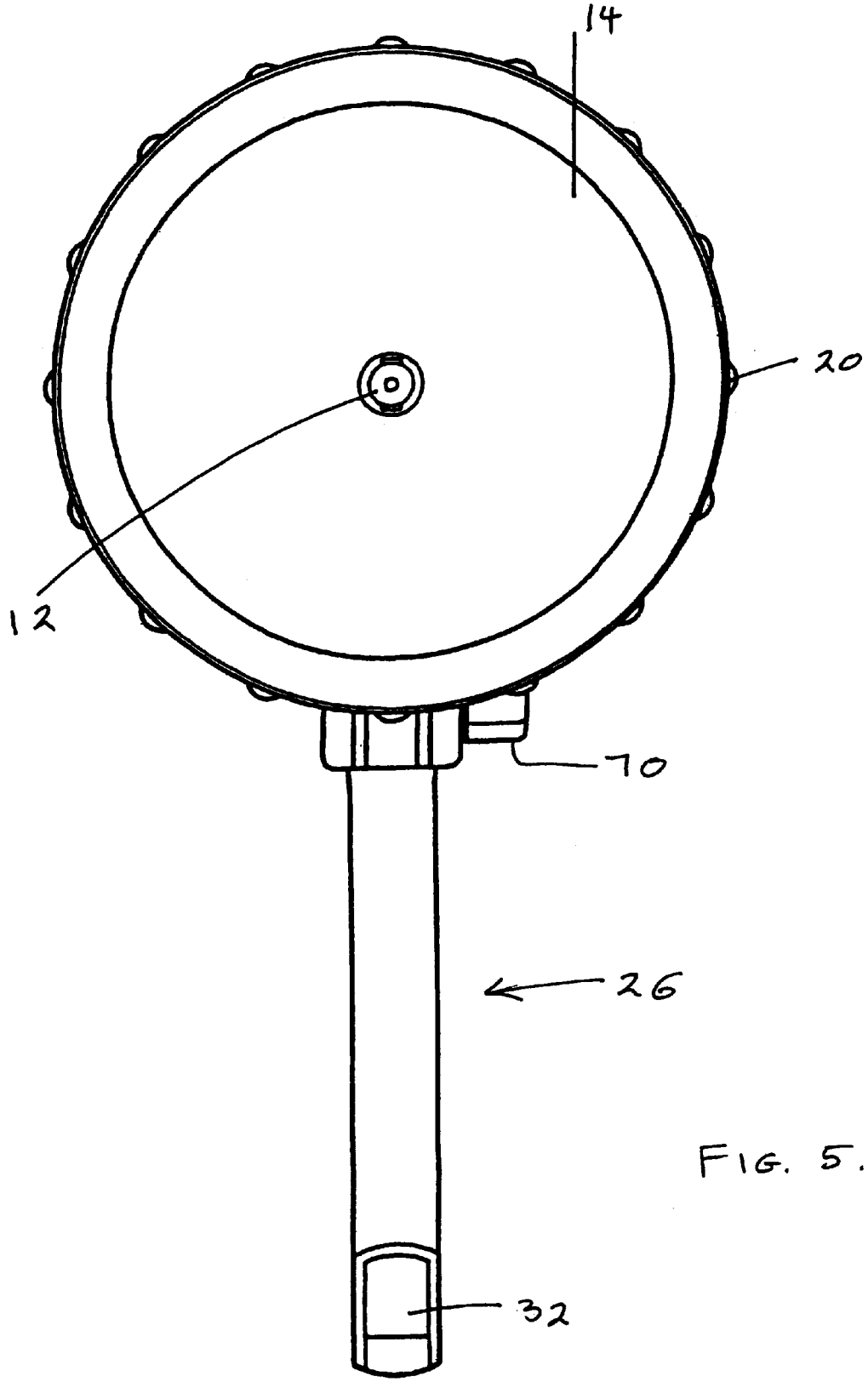
Figure 6:
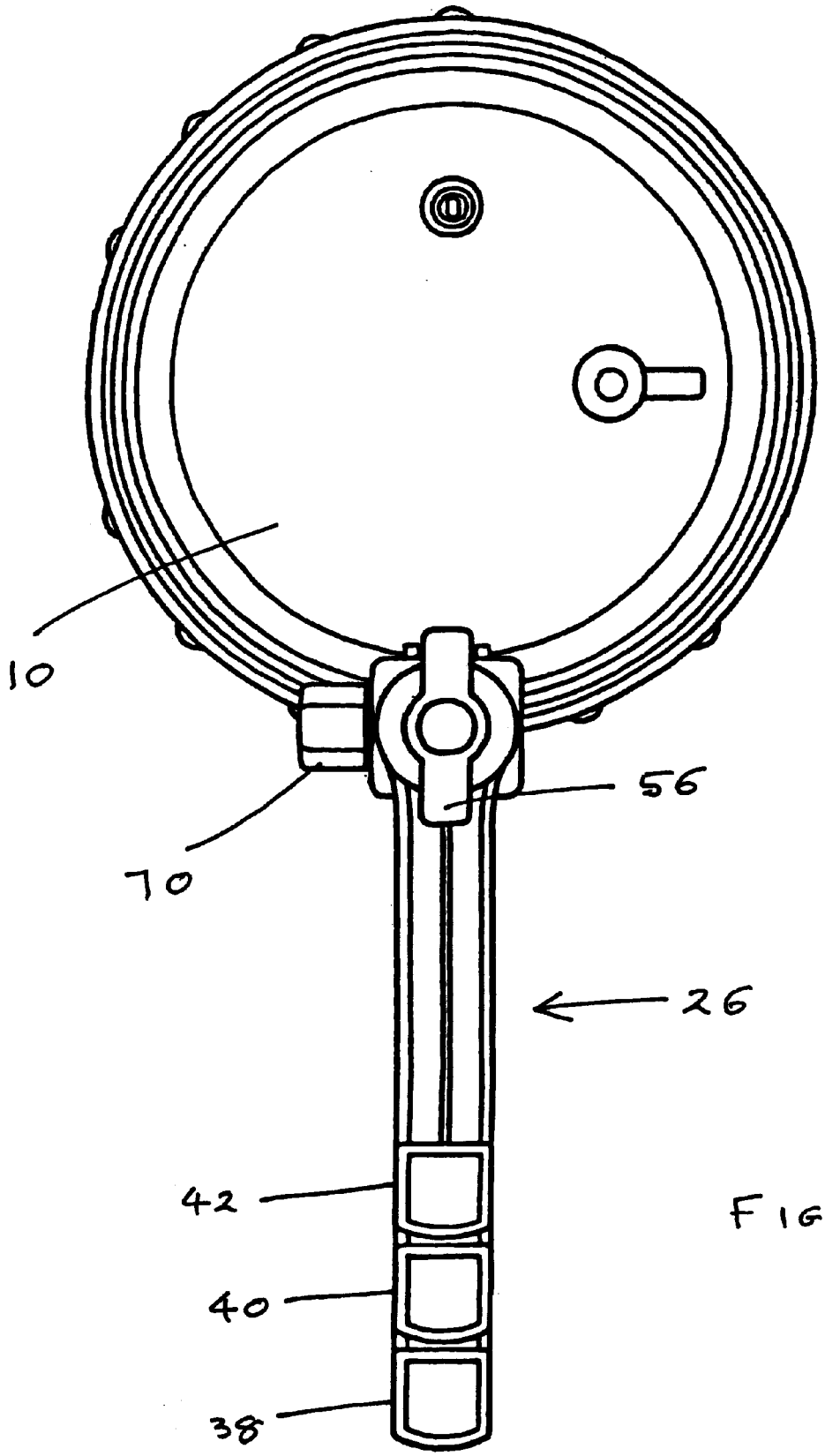
Figure 7:
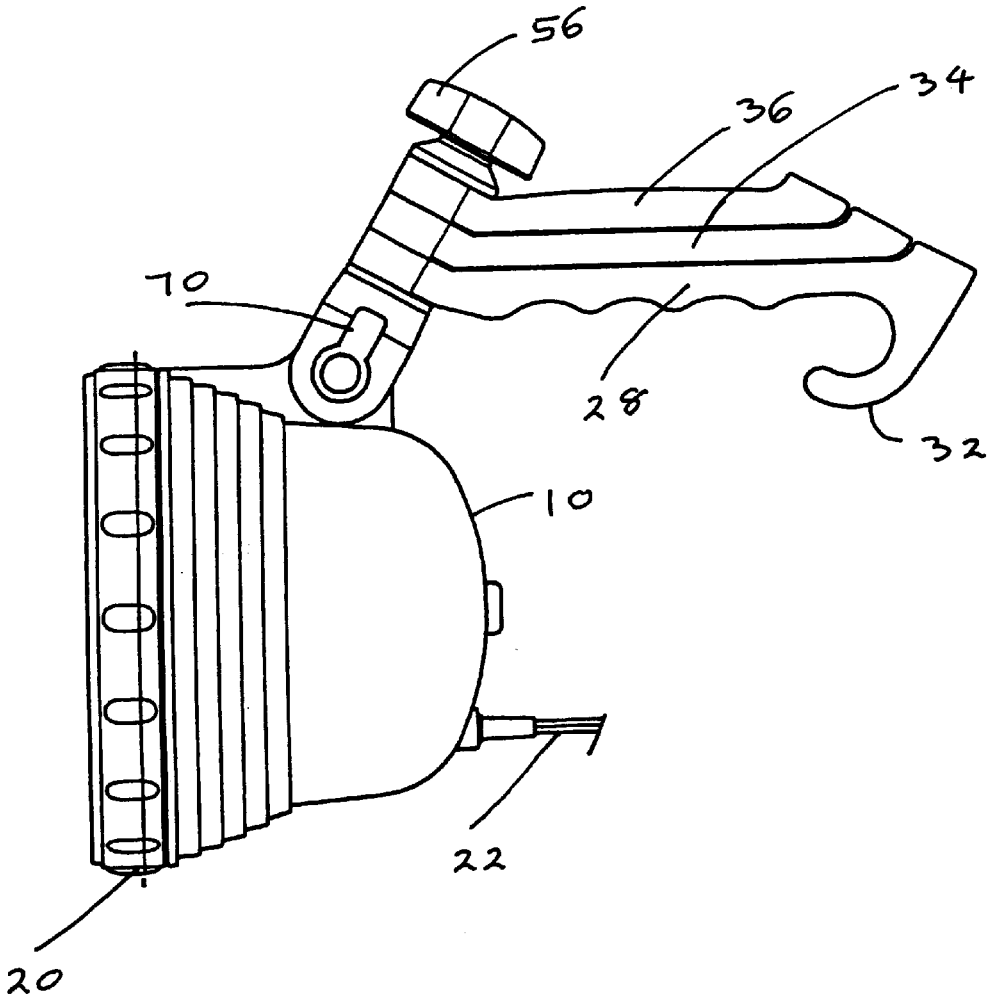
Figure 8:
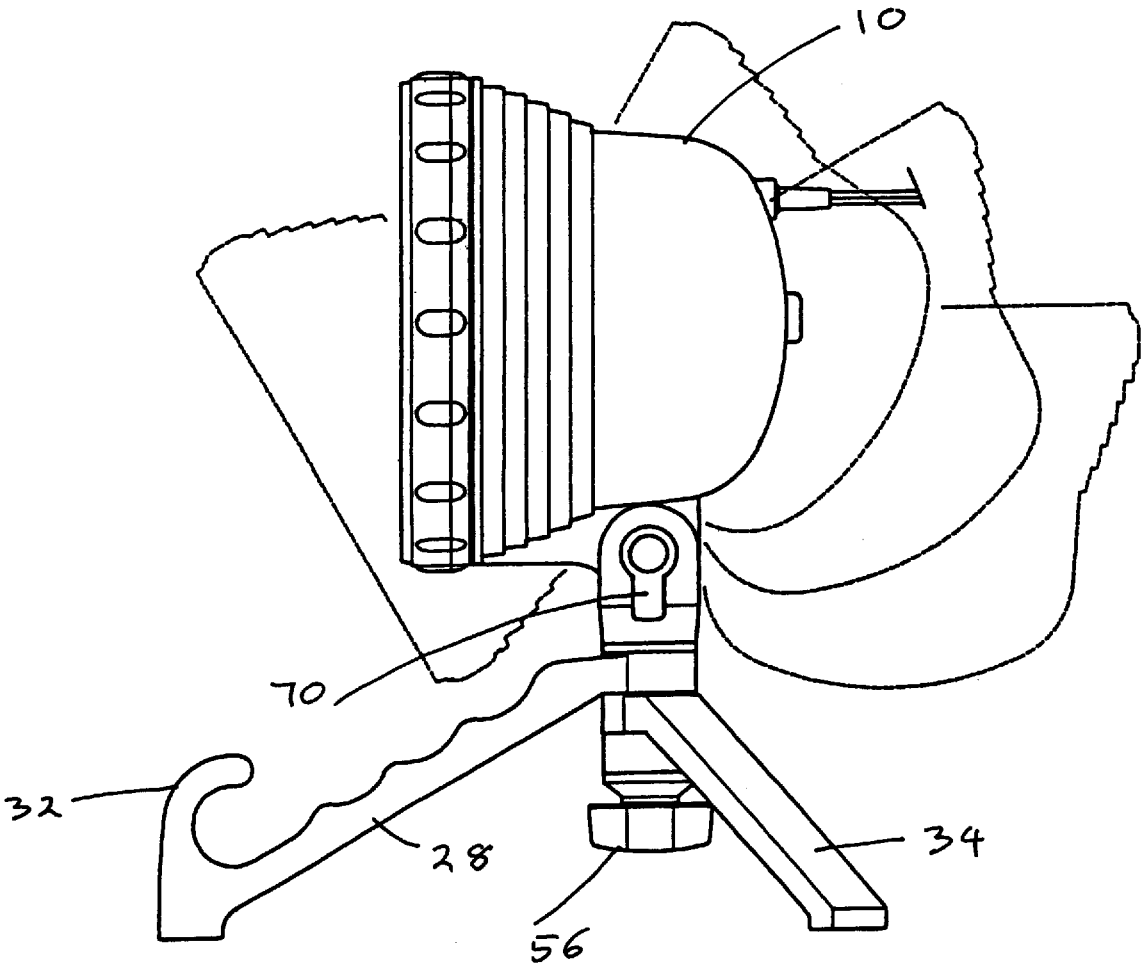
Figure 9:
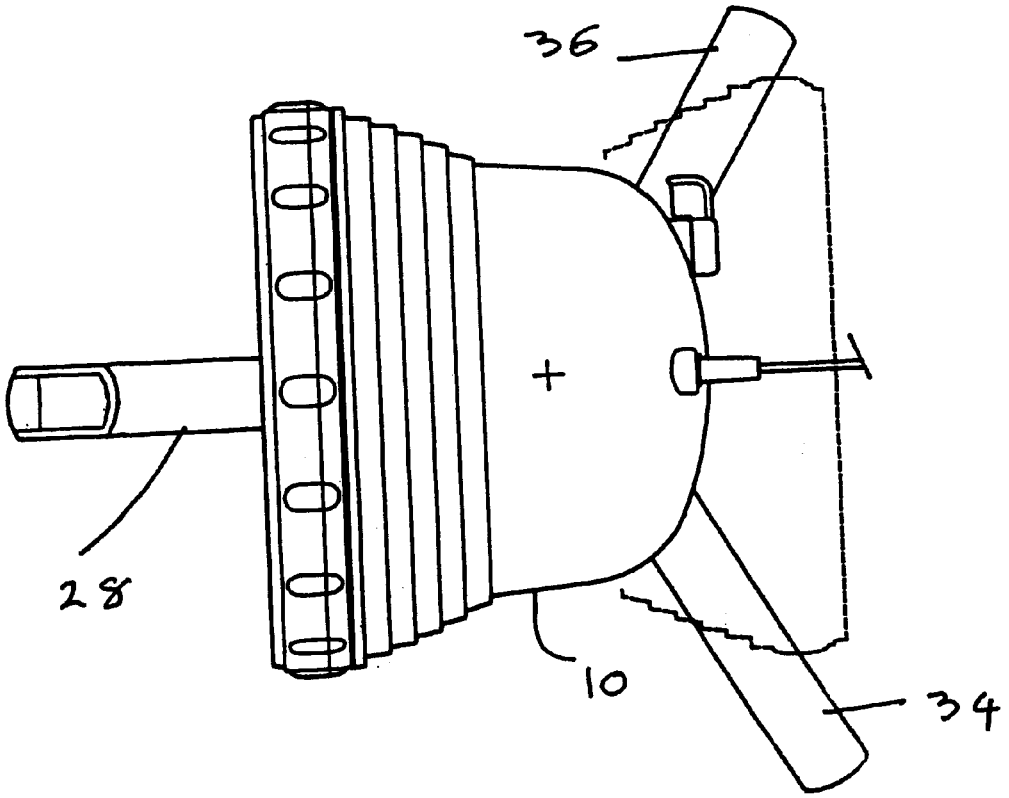

Other features of the invention will become apparent from the following description given herein solely by way of example with reference to the accompanying drawings wherein FIG. 1 is a side view of a lantern constructed in accordance with the invention showing the handle elements in their said first position to provide a handle proper, FIG. 2 is a longitudinal cross-sectional view of the lantern shown in FIG. 1, FIG. 3 is an underneath plan view of the lantern shown in FIG. 1, FIG. 4 is a cross-sectional view on the line A—A of FIG. 2, FIG. 5 is a front view of the lantern shown in FIG. 1, FIG. 6 is a rear view of the lantern shown in FIG. 1, FIG. 7 is a side view of the lantern showing the handle proper in an alternative position relative to the body of the lantern, FIG. 8 is a side view of the lantern showing the handle elements in their said second position to provide a support for the lantern, and FIG. 9 is a top plan view of the lantern shown in FIG. 8.

A lantern constructed in accordance with the invention and as illustrated herein includes a body 10 of generally cylindrical configuration housing a light source 12, a generally parabolic reflector 14 and a planar front element 16 of glass or other transparent material. The inner face of the front element 16 is sealed by an O-ring 18 to the front of the reflector 14 within a front annular cap 20 detachably secured to the front of the body 10.

As illustrated, the light source 12 comprises a bulb energisable by mains electrical power connected by a power cord 22 to an electrical connector 24 at the rear of the body 10 although it should be appreciated that the light source could be battery powered or gas powered.

A handle device 26 movable relative to the body 10 includes three handle elements comprising a front element 28 having a sculpted forward facing surface 30 and a hook shaped outer end 32, an intermediate element 34 and a rear element 36. Each of said elements is of elongate form provided with a respective outer lower planar surface 38, 40, 42, the elements being of such length that when in the positions relative to one another shown in FIGS. 1–7, the planar surfaces 38, 40, 42 are coplanar with one another.

The inner ends of the handle elements 28, 34, 36 comprise respective generally cylindrical bushings 44, 46, 48 whereby each handle element is rotatable relative to the others about a common pivot axis comprising the central longitudinal axis of a bolt 50. The head 52 of the bolt is secured fast within a housing 54 itself pivotally mounted on the lantern body 10 whereas the outer end of the bolt 50 is provided with a locking knob 56 fast with a nut 58 and lock nut 59 screw threaded on the end of the bolt 50. Clockwise rotation of the knob 56 compresses elastomeric O-rings 60 provided between the bushings 44–46 and 46–48 thus providing a friction lock of the handle elements 28, 34, 36 relative to one another and to the bolt 50. Counter-clockwise rotation of the knob 56 loosens the friction lock between the handle elements whereby they may be pivoted relative to one another about the longitudinal axis of the bolt 50.

The inner end of the housing 54 includes two spaced bushings 62 each located at the outer face of a respective one of two spaced parallel lugs 64 integral with the lantern body 10. An inner part 66 of each bushing 62 extends through a respective aperture in a lug 64, and a bolt 68 extends through the bushings and the lugs providing a pivot axis for the housing 54 relative to the lantern body 10.

A locking knob 70 is provided fast with the head 72 of the bolt 68 and a nut 74 is screw threaded on the other end of the bolt and retained within a closure cap 76. Clockwise rotation of the knob 70 tightens the housings 62 relative to the lugs 64 thus locking the housing 54 and hence the bolt 50 relative to the lantern body 10.

It will be appreciated that in the relative positions of the handle elements 28, 34, 36 shown in FIGS. 1–7, the elements are positioned in side-by-side relationship to provide a handle proper for holding by a user of the lantern. The relative position of the handle device 26 relative to the lantern body 10 can be selected by appropriate pivoting of all of the handle elements together about the longitudinal axis of the bolt 50 and/or by pivoting the bolt 50 and handle elements about the longitudinal axis of the bolt 68. For example, an alternative position of the handle proper relative to the lantern body is shown in FIG. 7.

In accordance with the invention the handle elements 28, 34, 36 are moveable relative to one another between a first position defining a handle proper as hereinbefore described with reference to FIGS. 1–7 and a second position in which said elements provide a support for the lantern. Referring to FIGS. 8 and 9, the handle elements are shown pivoted about the longitudinal axis of the bolt 50 so as to be equi-angularly displaced relative to said axis to provide a tripod assembly for supporting the lantern body. The bolt 50 is shown pivoted downwardly through 90° from the position shown in FIGS. 1–7 so as to be substantially vertical whereby the respective planar surfaces 38, 40, 42 of the handle elements 28, 34, 36 are engagable with a horizontal surface for supporting the lantern body. In FIG. 8, the angle of the lantern body 10 about the axis of the bolt 68 is selectable between the positions illustrated in chain dot outline whereas in FIG. 9, the lantern body 10 is shown in chain dot outline rotated through 180° about the axis of the bolt 50.

What is claimed is:

1. A lantern comprising a body having a light source and a handle device attached to said body; the handle device comprises a plurality of handle elements moveable relative to one another between a first position in which said elements provide a handle proper for holding by a user of the lantern and a second position in which said elements provide a support by which the lantern may be supported on a surface;

said handle elements are all pivotal about a common axis between said first position in which said elements are in side-by-side relationship to provide said handle proper and said second position in which said elements are separated from one another to provide said support; and said common axis comprises the longitudinal axis of a first elongate member itself pivotal relative to said body about an axis normal to said common axis.

2. A lantern as claimed in claim 1, wherein said normal axis comprises the longitudinal axis of a second elongate member mounted on said body.

3. A lantern as claimed in claim 1, wherein said handle elements are retainable in position relative to one another by friction means.

4. A lantern as claimed in claim 3 wherein said friction means is actuable by rotation of a locking member about said common axis.

5. A lantern as claimed in claim 2, wherein said first elongate member is retainable in position relative to said body by friction means.

6. A lantern as claimed in claim 5 wherein said friction means is actuable by rotation of a locking member about said longitudinal axis of said second elongate member.

7. A lantern as claimed in claim 1, wherein each of said handle elements is of elongate form each having an inner end provided with a bushing mounted for rotation about said common axis.

8. A lantern as claimed in claim 7 wherein each of said handle elements has an outer surface all of which are coplanar in both said first and second positions.

9. A lantern as claimed in any one of the preceding claims wherein three said handle elements are provided.

* * * * *

UNITED STATES PATENT AND TRADEMARK OFFICE

CERTIFICATE OF CORRECTION

PATENT NO. : 6,394,631 B1
DATED : May 28, 2002
INVENTOR(S) : Yuen

It is certified that error appears in the above-identified patent and that said Letters Patent is hereby corrected as shown below:

Column 4,
Line 25, "any one of the preceding claims" should read -- claim 1 --

Signed and Sealed this

Nineteenth Day of August, 2003

JAMES E. ROGAN
*Director of the United States Patent and Trademark Office*